United States Patent [19]

Pringle

[11] Patent Number: 4,669,547

[45] **Date of Patent: * Jun. 2, 1987**

[54] HIGH TEMPERATURE SUBSURFACE SAFETY VALVE

[75] Inventor: Ronald E. Pringle, Houston, Tex.

[73] Assignee: Camco, Incorporated, Houston, Tex.

[ * ] Notice: The portion of the term of this patent subsequent to Jul. 9, 2002 has been disclaimed.

[21] Appl. No.: 871,958

[22] Filed: Jun. 9, 1986

Related U.S. Application Data

[63] Continuation-in-part of Ser. No. 710,737, Mar. 11, 1985, which is a continuation-in-part of Ser. No. 538,000, Sep. 30, 1983, Pat. No. 4,527,630, which is a continuation-in-part of Ser. No. 383,897, Jun. 1, 1982, abandoned.

[51] Int. Cl.[4] ..... E21B 43/12

[52] U.S. Cl. ..... 166/321; 166/332; 251/62

[58] Field of Search ..... 166/321, 319, 323, 324, 166/332, 72; 251/62, 63, 63.5; 92/170, 248

[56] References Cited

U.S. PATENT DOCUMENTS

| | | | |
|---|---|---|---|
| 2,862,775 | 12/1958 | Kupiec | 92/246 |
| 3,662,986 | 5/1972 | Domulewicz, Sr. | 251/368 |
| 4,049,052 | 9/1977 | Arendt | 166/183 |
| 4,119,146 | 10/1978 | Taylor | 166/321 |
| 4,161,219 | 7/1979 | Pringle | 166/324 |
| 4,215,748 | 8/1980 | Pace et al. | 166/322 |
| 4,252,197 | 2/1981 | Pringle | 166/72 |
| 4,452,310 | 6/1984 | Pringle et al. | 166/319 |
| 4,503,913 | 3/1985 | Carmody | 166/319 |
| 4,527,630 | 7/1985 | Pringle | 166/321 |

FOREIGN PATENT DOCUMENTS

| | | | |
|---|---|---|---|
| 2112454 | 7/1983 | United Kingdom | 92/170 |

*Primary Examiner*—James A. Leppink
*Assistant Examiner*—Hoang C. Dang
*Attorney, Agent, or Firm*—Fulbright & Jaworski

[57] ABSTRACT

A subsurface safety valve for controlling the fluid flow through a well conduit having an improved fluid actuator with a ceramic piston connected to and actuating the valve and movable in a ceramic sleeve. The actuator metal valve seats and metal valve elements for seating on the valve seats for providing positive seals.

5 Claims, 8 Drawing Figures

HIGH TEMPERATURE SUBSURFACE SAFETY VALVE

CROSS-REFERENCE TO RELATED APPLICATIONS

The present application is a continuation-in-part of co-pending patent application Ser. No. 06/710,737, filed Mar. 11, 1985 which is a continuation-in-part of patent application Ser. No. 06/538,000, filed Sept. 30, 1983, entitled Hydraulic Actuating Means For Subsurface Safety Valves, now U.S. Pat. No. 4,527,630, which is a continuation-in-part of patent application Ser. No. 06/383,897, filed June 1, 1982, now abandoned.

BACKGROUND OF THE INVENTION

In producing oil from wells, it has become important to provide a safety valve for use in high temperature environments. For example, in order to increase recovery, it is conventional to inject steam into a well to heat and thin the oil for increasing recovery. However, high temperatures are involved, such as 800 degrees F. Generally, an all metal safety valve such as disclosed in U.S. Pat. No. 4,527,630 would be sufficient with the exception of the lubricants necessary to operate the piston actuating means. Most lubricating fluids will not exist in a liquid state at extremely high temperatures to provide the desired lubricity needed for the metal piston and cylinder assembly.

The present invention is directed to a subsurface safety valve having a fluid actuator using a ceramic piston movable in a cylinder having a ceramic interior. A ceramic piston and cylinder need not provide a positive seal, but only resistance to fluid flow sufficient to actuate the safety valve. However, the ceramic piston and cylinder will withstand the extremely high temperatures without lubricants. In order to provide positive sealing, two spaced metal valve seats coact with two metal valve elements connected between the piston and cylinder for sealing the ceramic piston and cylinder assembly at opposite ends of travel.

SUMMARY

The present invention is directed to a subsurface well safety valve for controlling fluid flow through a well conduit which includes a housing and a valve closure member moving between open and closed positions for controlling the fluid flow through the bore. A flow tube is telescopically movable in the housing for controlling the movement of the valve closure member and biasing means are provided for moving the flow tube in a direction to close the valve. A cylinder is provided in the housing and the cylinder includes a ceramic interior. A ceramic piston is movable relative to the ceramic interior of the cylinder in response to fluid acting in the cylinder. One of the pistons and cylinders engages and moves the flow tube. The cylinder on one side of the piston is adapted to be in communication with a fluid control passageway and the cylinder on the second side of the piston is adapted to be in communication with a biasing fluid. First and second spaced metal valves seats are connected to one of the piston and cylinder and first and second metal valve elements are connected to the other of the piston and cylinder and coact with the first and second seats. The first and second elements are spaced from each other to alternately seat and unseat on the first and second valve seats, respectively, as the piston alternately moves relative to the cylinder.

A still further object of the present invention is wherein the piston includes a labyrinth seal.

Still a further object of the present invention is wherein the labyrinth seal includes a plurality of circular grooves.

Still a further object of the present invention is wherein the ceramic interior of the cylinder is a sleeve positioned between and spaced from the metal valve seats.

Other and further object, features and advantages will be apparent from the following description of a presently preferred embodiment of the invention, given for the purpose of disclosure and taken in conjunction with the accompanying drawings.

DESCRIPTION OF THE PREFERRED EMBODIMENTS

While the present invention will be described in connection with a subsurface tubing safety valve having a flapper type closure member, for purpose of illustration only, it is understood that the present invention may be used with other types of safety valves and other valve closure members.

Figure 1A:
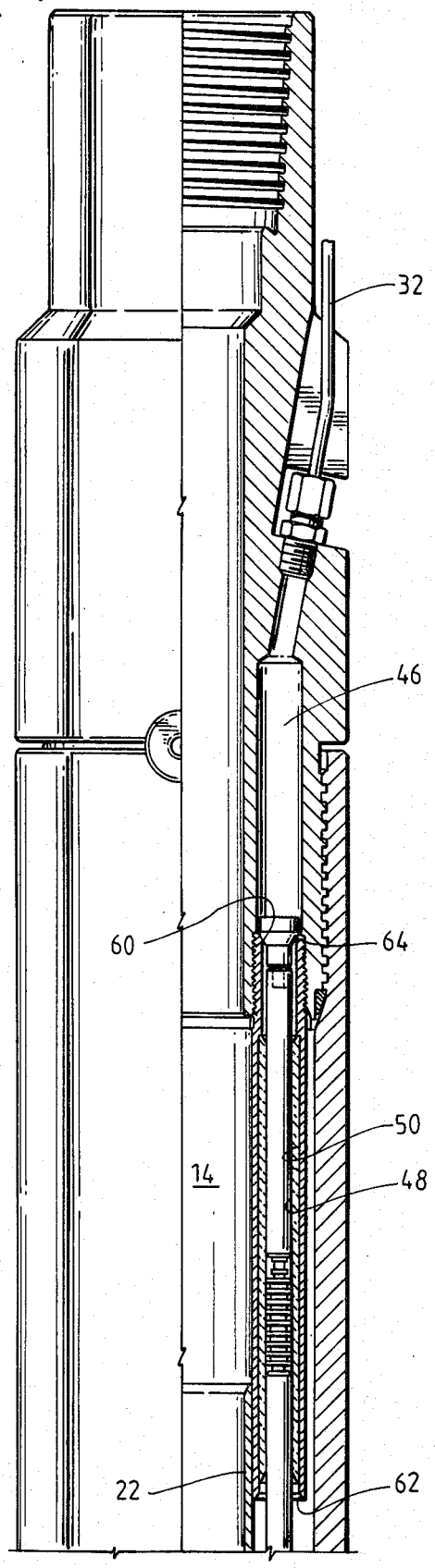
FIGS. 1A and 1B are continuations of each other and are an elevational view, in quarter section, of one embodiment of the well safety valve utilizing the present invention and shown in the open position.
Figure 1B:
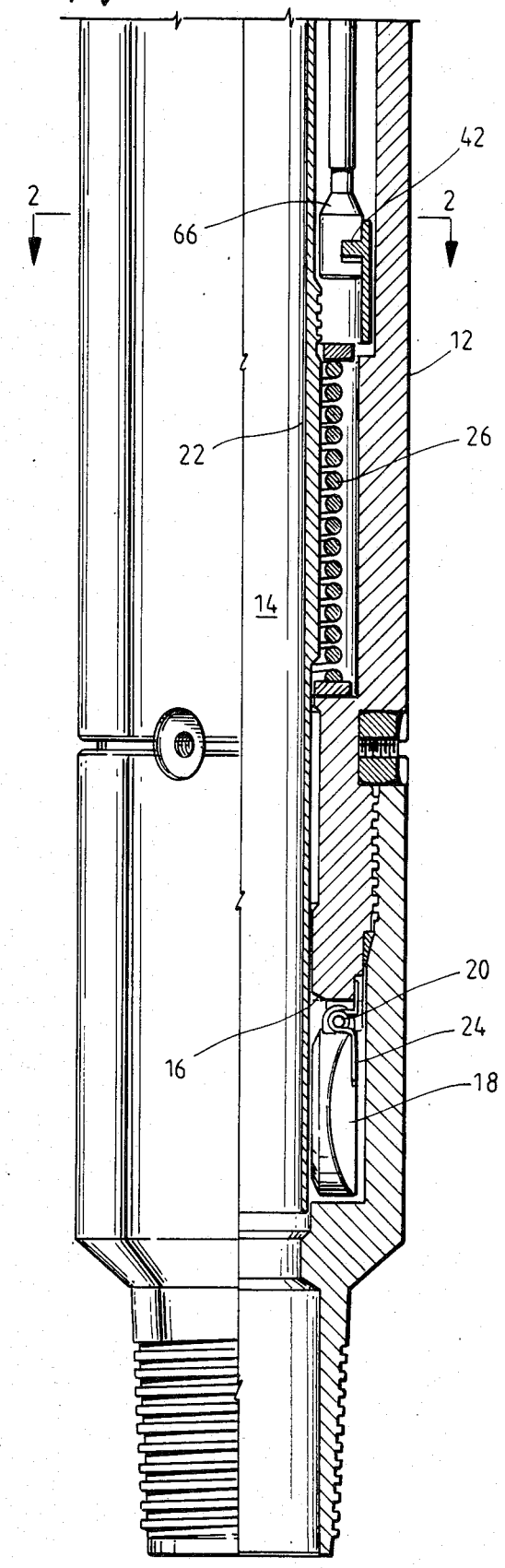

Referring now to the drawings, and particularly to FIGS. 1A and 1B, the reference numeral 10 generally indicates a subsurface tubing safety valve of the present invention which includes a body or housing 12 which is adapted to be connected in a well tubing to permit well production therethrough under normal operating conditions, but in which the safety valve may close or be closed in response to abnormal conditions.

The valve 10 includes a bore 14, an annular valve seat 16 positioned about the bore 14, a valve closure element such as a flapper valve 18 connected to the body 12 by a pivot pin 20. Thus, when the flapper valve 18 is in the upward position and seated on the valve seat 16, the safety valve 10 is closed blocking flow upwardly through the bore 14 and well tubing.

A longitudinal tubular member or flow tube 22 is telescopically movable in the body 12 and through the valve seat 16. As best seen in FIG. 1B, when the flow tube 22 is moved to a downward position, the tube 22 pushes the flapper 18 away from the valve seat 16. Thus the valve is held in the open position so long as the tube 22 is moved upwardly, the flapper 18 is allowed to move upwardly onto the seat 16 by the action of a spring 24.

The flow tube 22 is biased upwardly in an upward direction by any suitable means which may include a spring 26 for yieldably urging the flow tube 22 in an upward direction to release the flapper 18 for closing the valve 10. The safety valve 10 is controlled by the applicable or removal of a pressurized fluid, such as steam, through a control path or line, such as one or more control lines 32 extending to the well surface or through the casing annulus, which supplies pressurized steam to the top of one or more pistons 40 which are connected to the flow tube 22 by a tongue and groove connection 42 for moving the flow tube 22 downwardly forcing the flapper 18 off of the seat 16 and into the full open position. The safety valve 10 is controlled by the application or removal of pressurized fluid through the control line 32 and a fluid passageway 46 to supply pressurized fluid to a cylinder 48 and the top of the piston 40. The bottom of the piston 40 is exposed to fluid pressure in the bore 14, or in the case of other types of safety valves, to annulus fluid, which acts against the bottom of the piston 40 for biasing the flow tube 22 to the closed position when the fluid control pressure is removed from the control line 32.

The above description is generally disclosed in copending U.S. Pat. No. 4,527,630 which utilizes a metal piston. While the all metal safety valve of the prior application is a great improvement over pistons using elastomer seals and can be used in hostile and high temperature environments, the prior art of a metal piston and cylinder required lubricants. However, lubricants at the extremely high temperatures utilized in steam injection wells, for example 800 degrees F., do not exist in a liquid state. One feature of present invention is directed to a piston 40 made of a suitable ceramic which operates in a cylinder 48 having a ceramic interior such as a ceramic sleeve 50. A suitable ceramic is Type K-6 sold by Coors Ceramics. The ceramic piston 40 and the ceramic sleeve 50 have sufficient lubricity that they can withstand the extremely high temperatures encountered in steam injection wells. In order to operate, the piston 40 need not provide a positive seal in the cylinder 48 but need only provide a minimum leakage seal that offers resistance to fluid flow while providing clearance. Preferably, the piston 40 may be of a labyrinth seal such as plurality of circumferential grooves 52 which have a minimum of sealing action. In fact, the piston 40 could be merely a smooth elongated rod of ceramic material with a sufficiently close fit in the cylinder 48 whereby the pressure drop acting across the piston would be sufficient to move the flow tube 22.

However, since the ceramic piston 40 and sleeve 50 are provided with some leakage, it is desirable to provide positive valve element seals which will provide a positive seal in both directions for the double acting piston 40.

Figure 3:
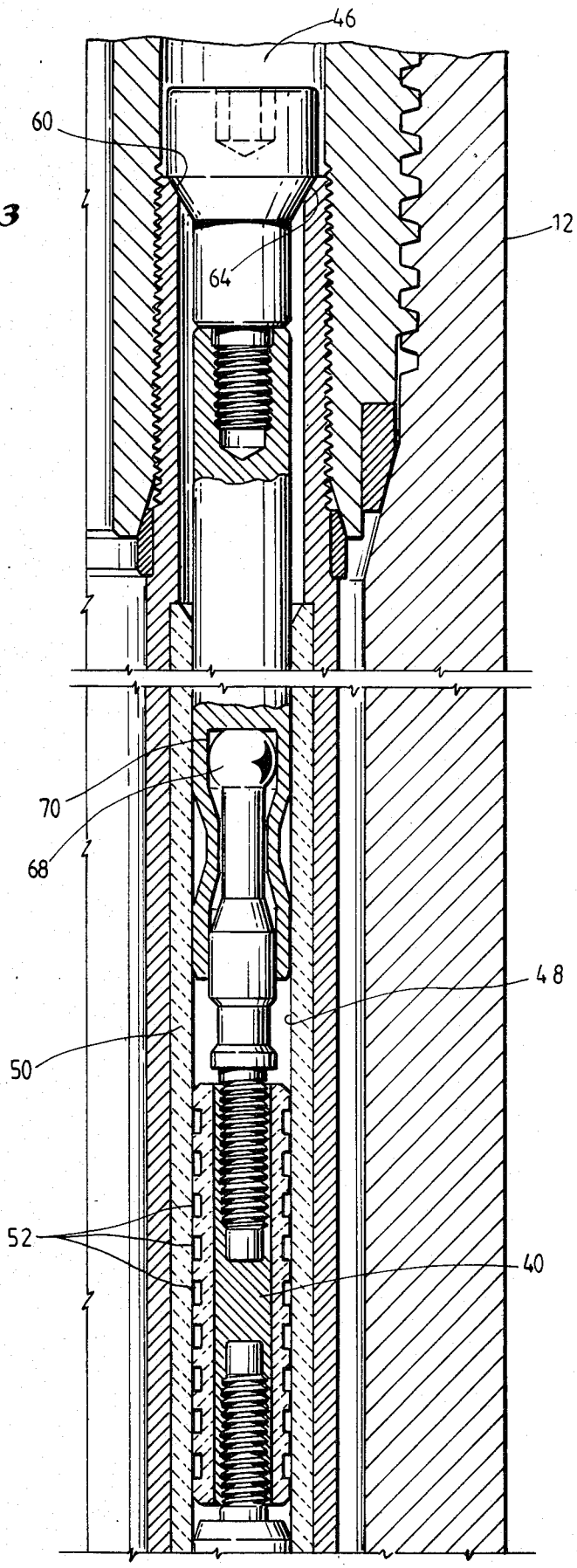
FIG. 3 is an enlarged fragmentary cross-sectional view of the fluid actuating means.

Referring now to FIG. 1A and 3, the cylinder 48 includes a first metal valve seat 60 on one side of the piston 40 and in communication with the fluid control passageway 46 whereby pressurized control fluid can flow to and actuate the top of the piston 40 through the valve seat 60. A second metal valve seat 62 (FIG. 1A) is provided on the cylinder 48 on the second side of the piston 40 through which biasing fluid pressure, such as in the bore 14, can flow to the bottom side of and actuate the piston 40. A first metal valve element 64 is provided connected to the first side of the piston 40 and is adapted to seat on the first valve seat 60 to provide a positive seal when the piston 40 moves away from the valve sat 60 (FIG. 1A and 3). A second metal valve element 66 (FIG. 1B) is adapted to seat on the second valve seat 62 and provide a positive seal when the piston 40 by a ball 68 and socket 70 universal connection for allowing the piston 40 to align itself properly in the cylinder 48 without binding.

Therefore, the piston 40 merely provides a dynamic seal in the piston 48 sufficient to cause movement of the piston 40 in the cylinder 4 48 to actuate the flow tube 22. The valve elements 64 and 66 provide static and positive seals when they are seated on their respective valve seats 60 and 62. Therefore, with the use of the positive valve element 64 and 66, leakage of fluids past the piston 40 will not cause the fluid actuating system to become inoperative so long as the piston 40 seals sufficiently in the cylinder 48 to move the valve element 64 and 66 to their seated positions. Once the valve elements 64 and 66 are in the seated position, fluid pressure acting on the back side of the elements 64 and 66 will positively seat and keep the valve elements 64 and 66 seated.

In operation, when pressurized control fluid such as steam, is supplied to the line 32, fluid will flow into the passageway 46 and into the cylinder 48 above the piston 40 moving the piston 40 downwardly which in turn carries the flow tube 22 downwardly to open the flapper 18. Downward movement of the piston 40 carries the valve element 64 downwardly until it contacts and seats on the valve seat 60 to provide a positive seal and further fluid pressure in the fluid passageway 46 acts on the back of the valve element 64 to hold it in the sealed position. When it is desired to close the valve, pressure in the fluid control line 32 is reduced thereby reducing the pressure in the passageway 46 and on top of the valve element 54. The biasing fluid pressure in the bore 14 of the safety valve 10 or in the casing annulus (not shown) is in communication with the cylinder 48 and the bottom of the piston 40 and along with the spring 26 biases the piston 40 in an upward direction until the valve element 66 is seated on the valve seat 62 to provide a positive seal in the upward direction. Thereafter, the biasing fluid pressure acts on the back of the valve element 66 along with the action of spring 26 to maintain the element 66 in a sealed position on the valve seat 62.

Figure 2:
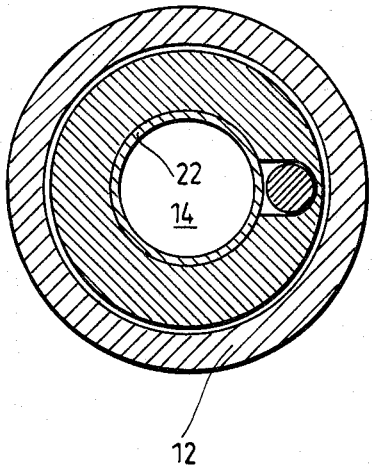
FIG. 2 is a cross-sectional view taken along the line 2—2 of FIG. 1*b*.
Figure 4A:
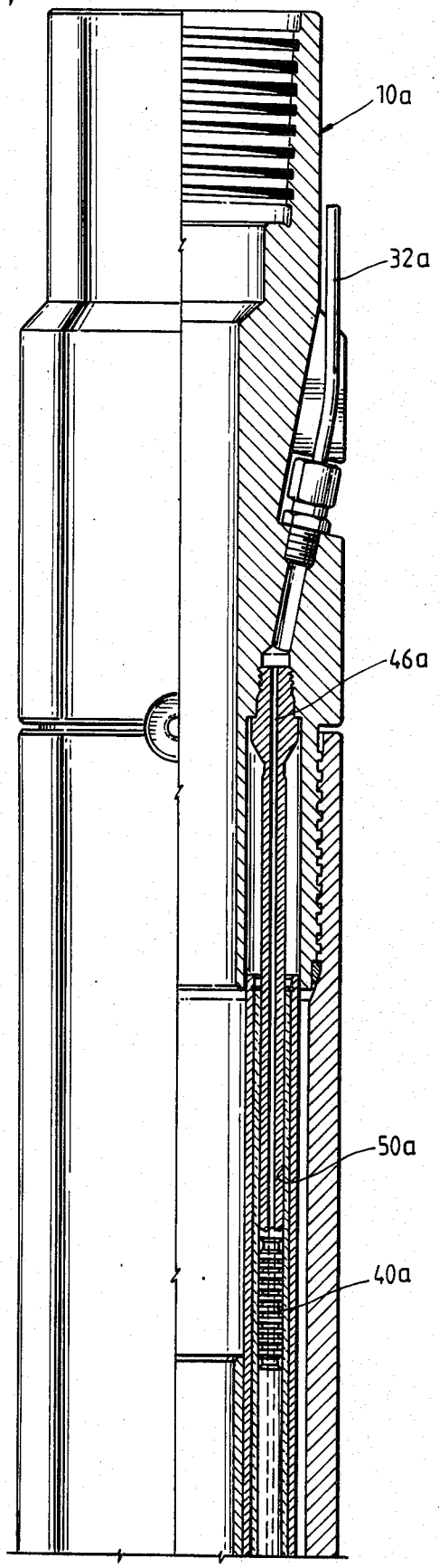
FIG. 4A and 4B are continuations of each other and are an elevational view, in quarter section, of another embodiment of the present invention.
Figure 4B:
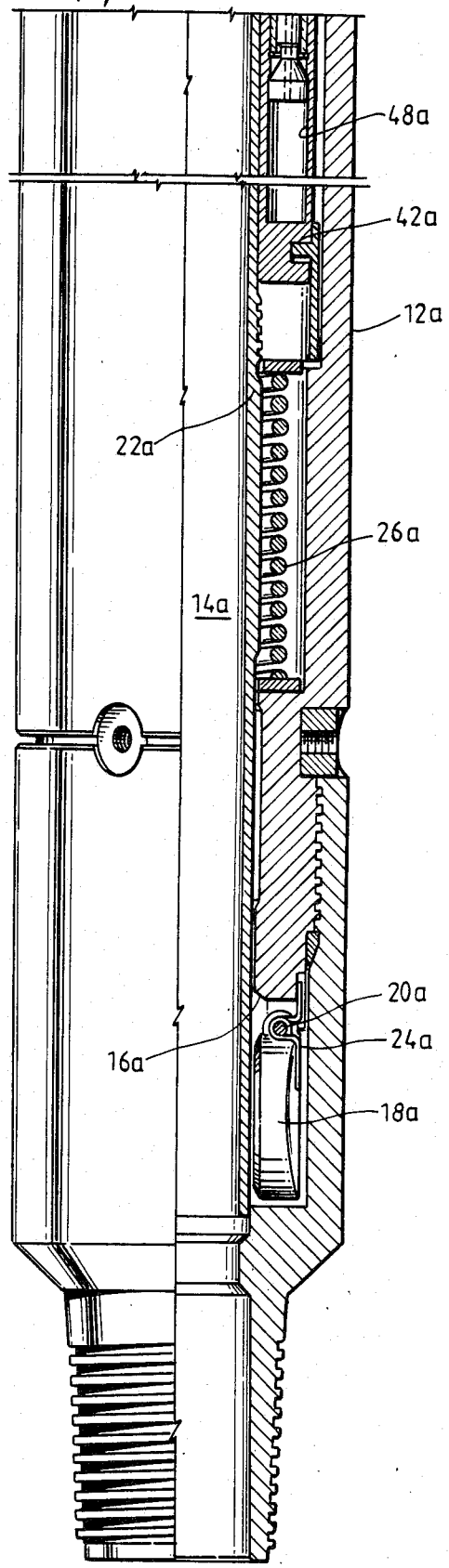
Figure 5A:
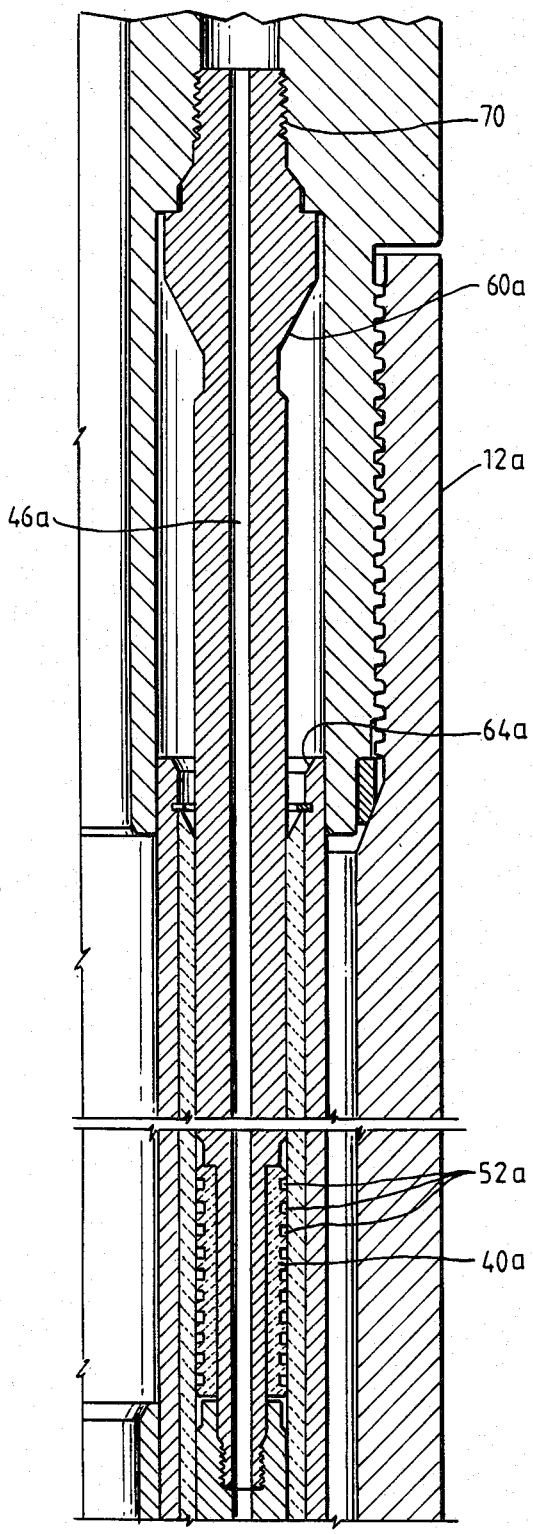
FIG. 5A and 5B are continuations of each other and is an enlarged fragmentary cross-sectional view of the fluid actuating means.
Figure 5B:
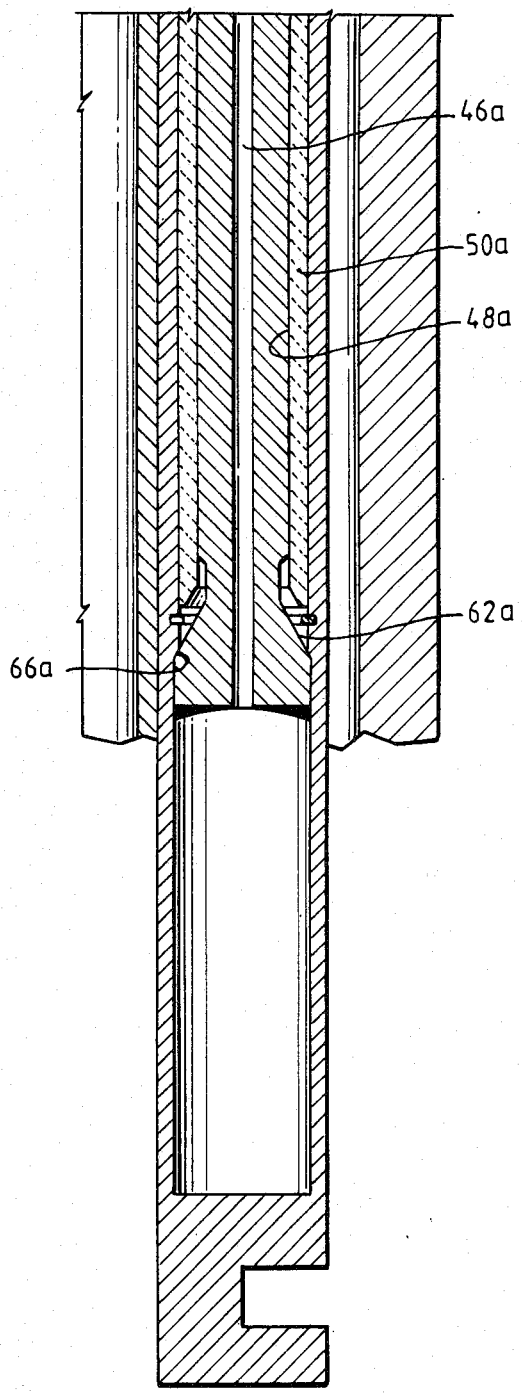

Referring now to FIGS. 4A, 4B, 5A and 5B, another embodiment of the present invention is seen which is similar to that FIGS. 1–3 with the exception that the piston and cylinder are reversed. Like numerals in FIGS. 4A, 4B, 5A and 5B to those of FIGS. of 1–3 refer to like parts with the addition of the suffix "a". Piston **40*a* is fixed and connected to the housing 12*a* by a threaded connection 70 and cylinder 48*a* is moveable and connected to the flow tube 22*a* by a tongue and groove connection 42*a*. The flow tube 22*a* is actuated by the admission of hydraulic fluid or steam into line 32*a* and through passageway 46*a*, which extends through the piston 40*a* for controlling the movement of the cylinder 48*c*. Again, the piston 40*a* includes a ceramic piston preferably having a labyrinth seal such as plurality of circumferential grooves 52*a* which are moveable relative to a ceramic sleeve 50*a* in the interior of the cylinder 48*a*. Upon reduction of the fluid pressure in the control line 32*a* the biasing fluid pressure in the bore 14*a* and the biasing spring 26*a* biases the cylinder 48*a* upwardly to allow the valve 18*a*** to close.

In order to provide positive valve element seals for providing a positive seals in both directions, a first metal valve seat **60*a* is provided on the piston 40*a* and is adapted to be engaged by a first metal valve element 64*a* on the cylinder 48*a*. A second metal valve element 66*a* is adapted to seat on a second valve seat 62*a* on the piston 40***a*. When the valve element 62*a* seats on the seat 66*a*, flow is shut off from the fluid control passageway 46*a* through the piston and cylinder assembly when the safety valve is opened. When the valve element 64*a* is seated on the valve seat 60*a* and the flow of the biasing fluid from the bore 14 to the piston and cylinder assembly is shut off when the safety is in the closed position. Therefore, the structure, operation and results of the embodiment of FIGS. 4A, 4B, 5A and 5B are similar to those of FIGS. 1–3 with the exception of the reversal of parts of the piston and cylinder and valve seats and valve elements.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. In a subsurface well safety valve for controlling the fluid flow through a well conduit and including a housing having a bore and a valve closure member moving between open and closed positions for controlling the fluid flow through the bore, a flow tube telescopically moving in the housing for controlling the movement of the valve closure member, and biasing means for moving the flow tube in a direction to close the valve, the improvement in fluid actuating means for actuating the flow tube comprising, a cylinder in the housing, said cylinder including a ceramic interior, a ceramic piston movable in the ceramic interior of the cylinder in response to fluid acting in the cylinder, said piston engaging and moving the flow tube, said cylinder on one side of the piston adapted to be in communication with a fluid control passageway, and said cylinder on the second side of the piston adapted to be in communication with a biasing fluid, said cylinder including first and second spaced metal valve seats, and first and second metal valve elements connected to the piston, said first and second elements spaced from each other to alternately seat and unseat on the first and second valve seats, respectively, as the piston alternately moves in the cylinder.

2. The apparatus of claim 1 wherein the piston includes a labyrinth seal.

3. The apparatus of claim 1 wherein the piston includes a plurality of circular grooves.

4. The apparatus of claim 1 wherein the ceramic interior of the cylinder is a sleeve positioned between and spaced from said metal seats.

5. In a subsurface well safety valve for controlling the fluid flow through a well conduit and including a housing having a bore and a valve closure member moving between open and closed positions for controlling the fluid flow through the bore, a tubular member telescopically moving in the housing for controlling the movement of the valve closure member, and biasing means for moving the tubular member in a direction to close the valve, the improvement in fluid actuating means for actuating the valve closure member, a cylinder in the housing, said cylinder including a ceramic interior, a ceramic piston in and movable relative to the ceramic interior of the cylinder in response to fluid flow between the cylinder and the piston, one of said cylinder and piston engaging and moving the tubular member, said cylinder on one side of the piston adapted to be in communication with a fluid control passageway, and said cylinder on the second side of the piston adapted to be in communication with a biasing fluid, first and second spaced metal valve seats connected to one of the piston and cylinder, and first and second metal valve elements which coact with the first and second seats, respectively, said seats connected to the other of the piston and cylinder, and said first seat and first valve element positioned to shut off flow from the fluid control passageway to the cylinder when the safety valve is opened, and said second seat and second valve element positioned to shut off flow of the biasing fluid to the cylinder when the safety valve is in the closed position.

* * * * *